US006773300B1

(12) United States Patent
Sudo et al.

(10) Patent No.: US 6,773,300 B1
(45) Date of Patent: Aug. 10, 2004

(54) MICROPHONE HOLDER

(75) Inventors: Yoshinori Sudo, Iwata (JP); Noritaka Fujiwara, Iwata (JP)

(73) Assignee: Yamaha Metanix Corporation (JP)

( * ) Notice: Subject to any disclaimer, the term of this patent is extended or adjusted under 35 U.S.C. 154(b) by 0 days.

(21) Appl. No.: 10/110,948

(22) PCT Filed: Nov. 13, 2000

(86) PCT No.: PCT/JP00/07989

§ 371 (c)(1),
(2), (4) Date: Apr. 18, 2002

(87) PCT Pub. No.: WO01/35697

PCT Pub. Date: May 17, 2001

(30) Foreign Application Priority Data

Nov. 12, 1999 (JP) ..... 11-321955

(51) Int. Cl.[7] ..... H01R 3/00
(52) U.S. Cl. ..... 439/500
(58) Field of Search ..... 439/500, 626; 381/409, 368, 355

(56) References Cited

U.S. PATENT DOCUMENTS

| | | | | |
|---|---|---|---|---|
| 5,823,820 A | * | 10/1998 | Patel et al. | 439/500 |
| 5,830,007 A | | 11/1998 | Fry et al. | |
| 6,093,056 A | * | 7/2000 | Donauer et al. | 439/500 |
| 6,217,349 B1 | * | 4/2001 | Konno | 439/91 |
| 6,220,892 B1 | * | 4/2001 | Bishop | 439/500 |
| 6,307,946 B1 | * | 10/2001 | Fujimoto et al. | 381/355 |
| 6,319,054 B1 | * | 11/2001 | Rippington | 439/500 |
| 6,508,663 B1 | * | 1/2003 | Uusima ki | 439/500 |
| 6,549,636 B2 | * | 4/2003 | Fujimoto et al. | 381/368 |
| 6,561,823 B1 | * | 5/2003 | Konno | 439/91 |
| 6,577,743 B2 | * | 6/2003 | Masuda et al. | 381/409 |

FOREIGN PATENT DOCUMENTS

| | | |
|---|---|---|
| JP | 1-140601 | 6/1989 |
| JP | 2-140995 | 5/1990 |
| JP | 5-207585 | 8/1993 |
| JP | 8-237797 | 9/1996 |
| JP | 11-27777 | 1/1999 |
| JP | 11-41682 | 2/1999 |
| JP | 11-55795 | 2/1999 |
| JP | 11-75279 | 3/1999 |
| JP | 11-285097 | 10/1999 |
| JP | 2000-268925 | 9/2000 |

* cited by examiner

*Primary Examiner*—Gary Paumen
(74) *Attorney, Agent, or Firm*—Dickstein, Shapiro, Morin & Oshinsky, LLP.

(57) ABSTRACT

In order to provide a microphone holder which can hold a microphone tightly and the holding operation can be performed easily, a microphone holder 10 comprises a holder casing 13 having an opening section 12 in one end of which a microphone 11 can be inserted and a connecting terminal 15 supported by the holder casing 13 so as to connect electrically the microphone 11 inside the holder casing and an outer section, the holder casing 13 comprises a side wall 20 and a bottom wall 21 communicating the side wall 20, an undercut sections 24 are provided on the upper edge of the side wall 20, the inside edge section 20 of the connecting terminal 15 is usually in the position having a space between the inside surface of the holder casing 13 and the inside edge section 20; thus, when the microphone 11 is inserted in the holder casing 13, the microphone 11 is held by being put between the undercut sections 24 and the inside edge section 29.

27 Claims, 2 Drawing Sheets

MICROPHONE HOLDER

TECHNICAL FIELD

The present invention relates to a microphone holder. In particular, the present invention relates to a microphone holder in which the microphone is held inside a microphone casing so as to be able to electrically connect to an outer component via a connecting terminal.

BACKGROUND ART

Conventionally, for example, a microphone is provided in a casing of a mobile phone and a transceiver, and a microphone holder is used for holding the microphone in a predetermined position. From the viewpoint of required functions, the microphone holder must maintain electrical contact between the microphone and the outer component such as a printed circuit board and must hold the microphone tightly. For that purpose, a microphone holder 50, as shown in FIG. 4 showing a conventional microphone holder, which can contain the microphone inside the microphone holder and can electrically connect the microphone and the outer section is proposed in, for example, Japanese Application No. Hei 10-178285.

The microphone holder 50 as shown in FIG. 4 comprises a rubber holder having approximately the same internal circumferential shape as the external circumferential shape of the microphone 51, a circumferential section 54 able to accept the rubber holder 52, a plurality of supporting plate section 55 provided on the bottom end of the circumferential section 54, a pair of foot sections 57 extending downward from the bottom end of the circumferential section 54 and which can be engaged with the outer section 56. On the bottom end of the rubber holder 52, an engaging projection part 59 is provided so as to be able to be engaged with a hole 55A provided on each supporting plate 55. An operation of attaching a microphone 51 to the microphone holder 50 is performed such that a microphone 51 is contained in a rubber holder 52, each engaging projection part 59 is engaged in a hole 55A, and a rib 61 of a front casing 60 pushes the top surface of the rubber holder 52.

However, in such a microphone holder 50, the structure of the microphone holder 50 not only becomes complicated, but there is also an disadvantage in that a plurality of components must be assembled so as to hold the microphone 51 tightly. Also, in order to achieve the electrical connectivity between the microphone 51 and the outer section 56, connecting operations such as soldering are inevitably required, and this connecting operation is disadvantageously burdensome. Furthermore, the rubber holder 52 and the circumferential section 54 have a space penetrating along the axial direction; thus, there is a disadvantage, called sound-leakage in which the sound input from the top surface of the microphone 51 leaks downward.

DISCLOSURE OF INVENTION

This invention was made in consideration of solving the above problems, and an object of the invention is to provide a microphone holder which can tightly hold a microphone located inside the holder casing while maintaining the electrical contact between the microphone and the predetermined outer section favorably so as to be able to attach the microphone to the holder casing easily.

In order to achieve above the object, a microphone holder of the present invention comprises a holder casing having an opening section in one end of which holder casing a microphone can be inserted and a microphone fall-off prevention section for holding the microphone, a connecting terminal supported by the holder casing so as to electrically connect the microphone inside the holder casing and a predetermined outer section. By this structure, it is possible to tightly hold the microphone inserted in the holder casing while maintaining the electrical connectivity between the microphone and the external section; thus, the disadvantages, such as a fall-off of a microphone from the holder casing, can be avoided effectively.

BEST MODE FOR CARRYING OUT THE INVENTION

In the present invention, it is possible to adopt a structure in which the inside end of the connecting terminal located in the holder casing is formed uniformly in the holder casing with an initial position having a space between an internal surface of the holder casing and the inside end of the connecting terminal. By employing such a structure, for example, if an initial position of the inside end of the connecting terminal is a position where the inside edge of connecting terminal contacts a surface of an electrode of a microphone which is inserted, the connecting terminal and the microphone can communicate electrically only if the microphone is inserted in the holder casing. Therefore, connecting operation for the outer section and the microphone shown in the manufacturing process of the conventional microphone holder can be omitted; thus, the manufacturing cost can be reduced.

In the present invention, it is possible to adopt a structure in which a sound leak prevention section is formed uniformly with the holder casing on the other end of the holder casing. By employing such a structure, a disadvantage can be avoided such as a sound-leak in which the sound input from one end of the holder casing leaks to the other end of the holder casing and the quality of the sound which was input deteriorates.

In the present invention, it is possible to adopt a structure in which preferably an elastic backup section is provided along the connecting terminal of the sound leak prevention section. By employing such a structure, the disadvantage that the elasticity of the connecting terminal is reduced during some time can be restricted.

Figure 2:
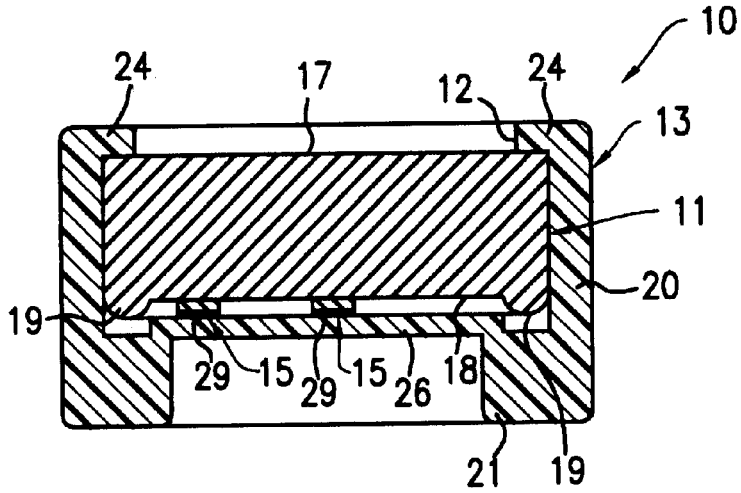
FIG. 2 is a cross section along line A—A showing a microphone held by a microphone holder of FIG. 1

In this specification, the terms such as "top", "upward" and "top end" indicate an upper side of the microphone holder in FIG. 2. Also, the terms such as "down", "downward" and "bottom end" indicate the opposite side of the microphone holder in FIG. 2. Additionally, the right-hand side and the left-hand side are determined with reference to FIG. 3.

Preferred embodiments of the present invention are explained as follows with reference to the drawings.

Figure 1:
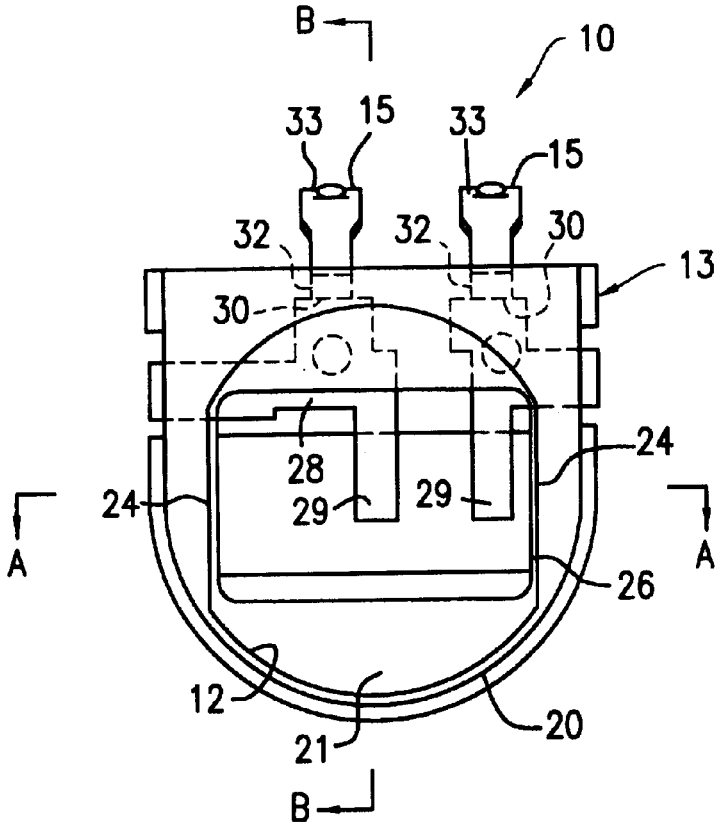
FIG. 1 is a plan view of a microphone holder of the present embodiment.

FIG. 1 is a plan view of a microphone holder of the present embodiment, and FIG. 2 is a cross section along line A—A showing a microphone held by a microphone holder of FIG. 1. In these drawings, although there are no limitations, a microphone holder 10 is disposed in a casing such as a mobile phone or a transceiver which is not shown in the drawing in the present embodiment. A microphone holder 10 comprises a holder casing 13 which is a container having a bottom having an opening section 12 in a top end side, in which a microphone 11 can be inserted, and two connecting terminals 15 supported by the holder casing 13.

The microphone 11 is approximately cylinderical as shown in FIG. 2. The top surface of the microphone 11 is a sound receiving surface 17. The bottom surface of the microphone 11 is an electrode surface 18. Also, on the bottom surface of the microphone 11, a projection section 19 with a closed-loop structure is provided along the outer surface of the microphone 11.

Figure 3:
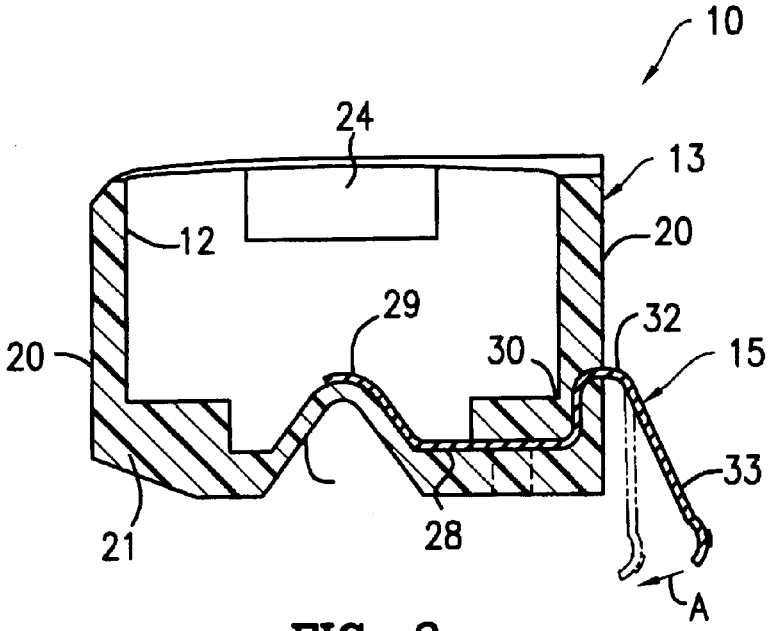
FIG. 3 is a cross section along line B—B showing a microphone held by a microphone holder of FIG. 1
Figure 4:
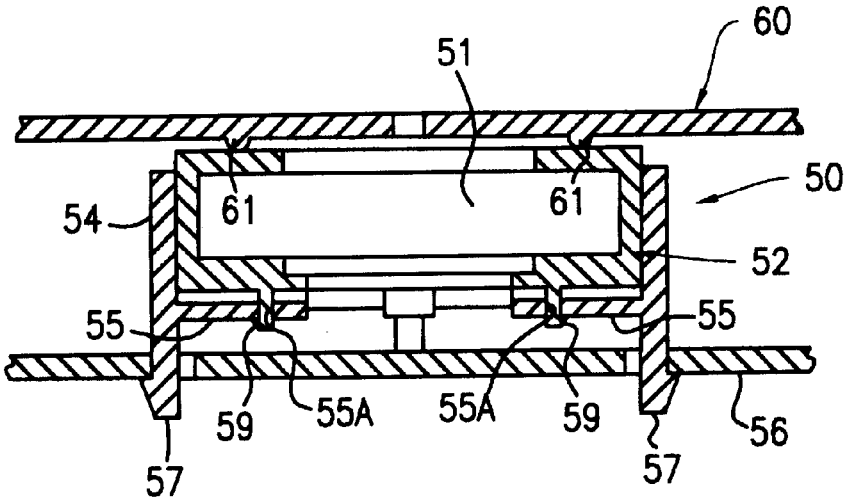
(PRIOR ART) FIG. 4
FIG. 4 is a cross section showing an approximate structure of a conventional microphone holder.

In the present embodiment, an opening section 12 is formed uniformly with the holder casing 13. Also, the opening section 12 is made from the elastic resin, and the opening section 12 can be enlarged intentionally by an additional force from the outside. The holder casing 13 comprises a side wall 20 having approximately the same internal shape as an external shape of the microphone and a bottom wall 21 as a sound leak prevention section communicating with the bottom surface of the side wall 20, and an opening section 12 in the upward direction. Also, undercut sections 24 preventing fall-off of the microphone by a projecting section projecting into the center are provided on the top end of the side wall 20 with an circumferential interval approximately by 180 degrees. By this undercut section 24, displacement of the microphone 11 in the upward direction in the microphone holder 13 can be restricted. Also, as shown in FIG. 3, in the central area of the bottom wall 21, a thin elastic backup section 26 is provided. The elastic backup section 26 is formed in a mountain-shape so as to project in the upward direction along the connecting terminals 15.

In the present embodiment, each connecting terminal 15 is made by bending a piece of metal plate by pressing operation and forming uniformly with the holder casing 13 with insert-molding method. As shown in FIG. 1 and FIG. 3, each connecting terminal 15 comprises a horizontal surface section 28 having a projecting area penetrating the side wall 20 and projecting to the outside disposed on the upper side of the bottom wall 21, an inside edge section 29 which is positioned next to the left-hand side in FIG. 3 of the horizontal surface section 28 so as to be added with the elastic backup section 26 with the tip of the inside edge section 29 directed to the upper left-hand side direction, a vertical surface section 30 which stands from the right-hand side of the horizontal surface section 28 in FIG. 3 and embedded in the side wall 20, an curved section 32 communicating to the upper end of the vertical surface section 30, and an outside end section 33 communicating to the curved section 32 and projecting to the outside.

As shown in FIG. 3, each inside edge section 29 has an initial position having a slight space between an inside edge section 29 and the surface of the elastic backup section 26. Each inside edge section 29 pushes the electrode surface 18 of the microphone 11 contained in the holder casing 13 by its cantilever plate spring structure. As shown in FIG. 1, the inside edge section 29 of the left-hand side can push the central position of the electrode surface 18, and the inside edge section 29 of the right-hand side can push the outer position of the electrode surface 18. Also, as shown in FIG. 3, each outside edge section 33 can be transformed in the direction of an arrow A so as to retreat therefrom by contacting the predetermined outer section (not shown in the drawing). Therefore, the electrical contact between the outside edge section 33 and the outer section can be maintained favorably by pushing the outer section until contacting the outside edge section 33. For the above structure, the operation of containing the microphone 11 in the microphone holder 10 is performed by pushing the microphone 11 into the opening section 12 forcefully. At this time, the opening section 12 is enlarged slightly so as to accept the insertion of the microphone 11, and undercut section 24 is engaged to the top edge of the microphone 11 when the insertion is completed. Also, when the microphone 11 is contained in the holder casing, the microphone 11 is placed vertically between the undercut section 24 and the inside edge section 29 of the connecting terminal 15. By doing this, the microphone 11 is held tightly from the axial direction and the radial direction with a tightening force of the side wall 20. Also, the inside edge section 29 pushes the electrode surface 18; thus, the electrical contact can be favorably maintained.

Therefore, according to this embodiment, the bottom wall 21 as a sound leak prevention section is formed uniformly with the holder casing 13, and the side wall 20 contacts the outer surface of the microphone 11 closely; thus, the effect that it is possible to reliably prevent the sound reaching at the sound receiving surface 17 of the microphone 11 from going through the holder casing 13 and leaking from the bottom side of the holder casing 13 is obtained.

In the present embodiment, although the inside edge section 29 of the contacting terminal 15 has a spring property to push the electrode surface 18 of the microphone 11, the present invention is not limited to such a construction. The height of the elastic backup section 26 can be higher than the position shown in FIG. 3 so as to push the inside edge section 29 and the electrode surface 18. By doing this way, if the contacting terminal does not have a spring property, electrical contact can be usually maintained.

Also, in the present embodiment, although the shape of the holder casing 13 is approximately cylindrical, the present invention is not limited to such a construction. The shape of the holder casing 13 can be, for example, a rectangular parallelepiped having an opening section 12 corresponding to the shape of the microphone 11. Furthermore, in the present embodiment, although the undercut sections 24 preventing fall-off of the microphone is provided on the top end of the side wall 20 with a circumferential interval approximately by 180 degree, the present invention is not limited to such a construction. The undercut sections 24 can be provided on the top end of the side wall 20 with an circumferential interval approximately by 90 degrees, 120 degrees, or in the vertically central area of the side wall 20. The present invention does not exclude any other structure of the undercut section as long as the microphone 11 is tightly engaged and held in the holder casing 13 so as not to fall off.

INDUSTRIAL APPLICABILITY

As explained above, according to the present invention, the holder casing which can contain the microphone therein is provided with the undercut section; thus, the superior effect that the microphone and the connecting terminal can be connected electrically only if the microphone is inserted in the opening section and the microphone is held tightly in the holder casing can be obtained.

Also, the initial position of the inside end of the connecting terminal has a space between an internal surface of the holder casing and the inside end of the connecting terminal;

thus, the electrode surface of the microphone and the connecting terminal can be electrically connected securely only if the microphone is contained in the holder casing, the conventional connecting step in the manufacturing process can be omitted so as to improve the productivity. Furthermore, the undercut section can also help holding the microphone together with the holder casing; thus, by doing this, the position of the microphone can be maintained stably.

Also, if a sound leak prevention section is formed uniformly with the holder casing, it is possible to effectively avoid a disadvantage such as sound-leak in which the sound input to the microphone leaks through the holder casing.

Furthermore, an elastic backup section is provided in the sound leak prevention section; thus, it is possible to dispose the microphone inserted in the holder casing at a fixed position, and to compensate for the reduced spring force of the inside edge section of the connecting terminal.

What is claimed is:

1. A microphone holder comprising:

a holder casing which is enclosed except for an opening section through which a microphone can be inserted, the holder casing preventing the microphone from falling out of the holder casing after it has been inserted into the holder casing;

an electrical connecting terminal supported by the holder casing and extending from a position inside the holder casing at which the connecting terminal can contact a microphone placed inside the holder casing to a position located outside of said holder casing.

2. A microphone holder according to claim 1, wherein an inside end of the connecting terminal located in the holder casing is has an initial position having a space between an internal surface of the holder casing and the inside end of the connecting terminal before the microphone is inserted into the holder casing.

3. A microphone holder according to claim 1 or 2, wherein the opening section is located at one end of the holder casing; and the holder casing includes a sound leak prevention selection on an opposite end of the holder casing.

4. A microphone holder according to claim 3, wherein the sound leak prevention section includes an elastic backup section is located below the inside end of the connecting terminal.

5. A microphone holder according to claim 1, wherein the holder casing has a microphone receiving space which is generally cylindrical in shape.

6. A microphone holder according to claim 5, wherein the opening section is located at one axial end of the microphone receiving space.

7. A microphone holder according to claim 1, wherein the holder casing includes a lip located at the opening section for holding a microphone in the holder casing after the microphone has been inserted into the holder casing.

8. A microphone holder according to claim 1, wherein the electrical connecting terminal is insert molded into the holder casing.

9. A combination comprising:

a microphone having a sound receiving surface;

a casing fully enclosing the microphone such that only the sound receiving surface of the microphone is exposed to the atmosphere surrounding the casing; and an electrical connecting terminal having an first end located in the casing and being connected to an electrical terminal of the microphone and a second end located outside of the casing.

10. The combination according to claim 9, wherein the electrical connecting terminal extends through a wall of the casing and is supported by the wall of the casing.

11. The combination according to claim 10, wherein the electrical connecting terminal is insert molded into the wall of the casing.

12. The combination according to claim 9, wherein the casing has a microphone receiving space in which the microphone is received and wherein the shape and size of the microphone receiving space corresponds to the shape and size of an outer surface of the microphone.

13. The combination according to claim 12, wherein the outer surface of the microphone is snuggly received in the microphone receiving space.

14. The combination according to claim 9, wherein the casing has an opening through which the microphone is inserted into the casing, the sound receiving surface of the microphone facing the opening.

15. The combination according to claim 14, wherein the portion of the casing surrounding the opening is flexible so that the microphone can be pushed through the opening.

16. The combination according to claim 15, further including a lip formed at the opening for holding the microphone in the casing after the microphone has been inserted into the casing.

17. The combination according to claim 14, further including a lip formed at the opening for holding the microphone in the casing after the microphone has been inserted into the casing.

18. The combination according to claim 9, wherein the first end of the electrical connecting terminal is pressed against the electrical terminal of the microphone by a bottom surface of the holder.

19. A combination comprising:

a microphone having at least one side surface and a sound receiving surface;

a casing filly enclosing the at least one side surface of the microphone and having an opening through which the microphone can be inserted into the casing, the sound receiving surface facing the opening such that it is exposed to the atmosphere external of the casing; and an electrical connecting terminal having an first end located in the casing and being connected to an electrical terminal of the microphone and a second end located outside of the casing.

20. The combination according to claim 19, wherein the electrical connecting terminal extends through a wall of the casing and is supported by the wall of the casing.

21. The combination according to claim 20, wherein the electrical connecting terminal is insert molded into the wall of the casing.

22. The combination according to claim 19, wherein the casing has a microphone receiving space in which the microphone is received and wherein the shape and size of the microphone receiving space corresponds to the shape and size of an outer surface of the microphone.

23. The combination according to claim 22, wherein the outer surface of the microphone is snuggly received in the microphone receiving space.

24. The combination according to claim 19, wherein the walls of the casing surrounding the opening are flexible so that the microphone can be pushed through the opening.

25. The combination according to claim 24, further including a lip formed at the opening for holding the microphone in the casing after the microphone has been inserted into the casing.

26. The combination according to claim 19, further including a lip formed at the opening for holding the microphone in the casing after the microphone has been inserted into the casing.

27. The combination according to claim 19, wherein the first end of the electrical connecting terminal is pressed against the electrical terminal of the microphone by a bottom surface of the holder.

* * * * *